US007934724B1

(12) United States Patent
Esquivel et al.

(10) Patent No.: US 7,934,724 B1
(45) Date of Patent: May 3, 2011

(54) ROLE-PLAYING BOARD GAME

(76) Inventors: Andrew J. Esquivel, Galdstone, OR (US); Brian L. Esquivel, Gladstone, OR (US)

( * ) Notice: Subject to any disclaimer, the term of this patent is extended or adjusted under 35 U.S.C. 154(b) by 0 days.

(21) Appl. No.: 12/546,646

(22) Filed: Aug. 24, 2009

Related U.S. Application Data

(60) Provisional application No. 61/092,325, filed on Aug. 27, 2008.

(51) Int. Cl.
*A63F 3/00* (2006.01)

(52) U.S. Cl. ..... 273/241; 273/262; 273/276; 273/283; 273/287

(58) Field of Classification Search ..... 273/241, 273/255, 262, 283, 285, 287
See application file for complete search history.

(56) References Cited

U.S. PATENT DOCUMENTS

| | | | | |
|---|---|---|---|---|
| 3,343,841 | A * | 9/1967 | Arend | 273/262 |
| 5,954,332 | A | 9/1999 | Mero et al. | |
| 6,554,279 | B1 | 4/2003 | Vanderhye | |
| 6,585,265 | B2 | 7/2003 | Dewa et al. | |
| 6,938,898 | B2 | 9/2005 | Merritt, III | |
| 6,978,999 | B2 | 12/2005 | Kline et al. | |
| 2004/0084841 | A1 * | 5/2004 | Murrell | 273/276 |
| 2006/0038349 | A1 | 2/2006 | Meeks | |
| 2006/0043674 | A1 * | 3/2006 | Van Ness | 273/241 |

* cited by examiner

*Primary Examiner* — Vishu K. Mendiratta
(74) *Attorney, Agent, or Firm* — Crossley Patent Law; Mark A. Crossley

(57) ABSTRACT

A role-playing board game in which players strategically build structures and destroy opponents' structures according to various game modes having a different objectives, by utilizing cards, a three-dimensional game board, three-dimensional models representing futuristic races and battlefield units, and various attachable accessories, along with a rule book, tokens, and a divided box for storing the tokens.

1 Claim, 10 Drawing Sheets

ROLE-PLAYING BOARD GAME

BACKGROUND OF THE INVENTION

Various types of board games and role-playing games are known in the prior art. Some of the role-playing board games also provide models and involve tactical skills. For example, one patent teaches a role playing game utilizing a set of cards. Another patent provides a combination role-playing and board game utilizing a plurality of models with detachable arms and head members and which are moved on a grid-like board surface that represents an arena where confrontations and other events are simulated. Still another patent provides a therapeutic role-playing board game. However, the present role-playing board game is generally designed to strategically build structures and destroy opponents' structures according to various game modes, each having a different objective, by utilizing cards, a three-dimensional game board, three-dimensional models representing futuristic races and battlefield units, and various attachable accessories, along with a rule book, tokens, and a box.

FIELD OF THE INVENTION

The present invention relates to board games, and more particularly, to a role-playing board game designed to strategically build structures and destroy opponents' structures according to various game modes, each having a different objective, which utilizes cards, a three-dimensional game board, three-dimensional models representing futuristic races and battlefield units, and various attachable accessories, along with a rule book and tokens.

SUMMARY OF THE INVENTION

In view of the aforestated known types of board games now present in the prior art, the general purpose of the present role-playing board game, described subsequently in greater detail, is to provide a board game which has many novel features that result in a board game which is not anticipated, rendered obvious, suggested, or even implied by prior art, either alone or in combination thereof.

To accomplish this, the present role-playing board game provides a plurality of 3-dimensional models representing two futuristic races, juggernauts and scythons, as well as terrain and battlefield units, a plurality of attachable accessory add-ons, a plurality of cards categorized as pilot cards, structure cards, add-on cards, and command cards, each card category providing a different set of capabilities, a plurality of game board pieces to construct a game board, a plurality of tokens, a plurality of boxes, and at least one die.

The instant role-playing board game is a turned-based strategy game utilizing a game board, representing a battlefield, which is expandable and customizable to suit the players' skills and strategic abilities. Each race is assigned unique abilities, skills, and strategy. The cards provide the characteristics of the action figures and statistics by game play proceeds. The tokens represent each player's resources including ore and alloys, command points, and status effects during game play. The attachable accessories customize game pieces to allow the models to perform different operations or to upgrade the models. The models are moved on the game board on each player's turn according to game instructions using a single die and cards, to simulate a battle. Players may also build more models according to their personal resources. There are four modes provided by which game play may proceed.

The present board game may be played an unlimited number of times by multiple players and players of a variety of ages. The lightweight and portable role-playing board game and game pieces can be easily transported to and played at almost any location.

Thus has been broadly outlined the more important features of the present role-playing board game and method so that the detailed description thereof that follows may be better understood and in order that the present contribution to the art may be better appreciated.

Numerous objects, features and advantages of the present role-playing board game will be readily apparent to those of ordinary skill in the art upon reading the following detailed description of presently preferred, but nonetheless illustrative, examples of the present role-playing board game and method when taken in conjunction with the accompanying drawings. In this respect, before explaining the current examples of the present role-playing board game and method in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the role-playing board game and method. It is therefore important that the claims be regarded as including such equivalent constructions insofar as they do not depart from the spirit and scope of the present invention.

Objects of the present role-playing board game and method, along with various novel features that characterize the invention are particularly pointed out in the claims forming a part of this disclosure. For better understanding of the role-playing board game and method, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
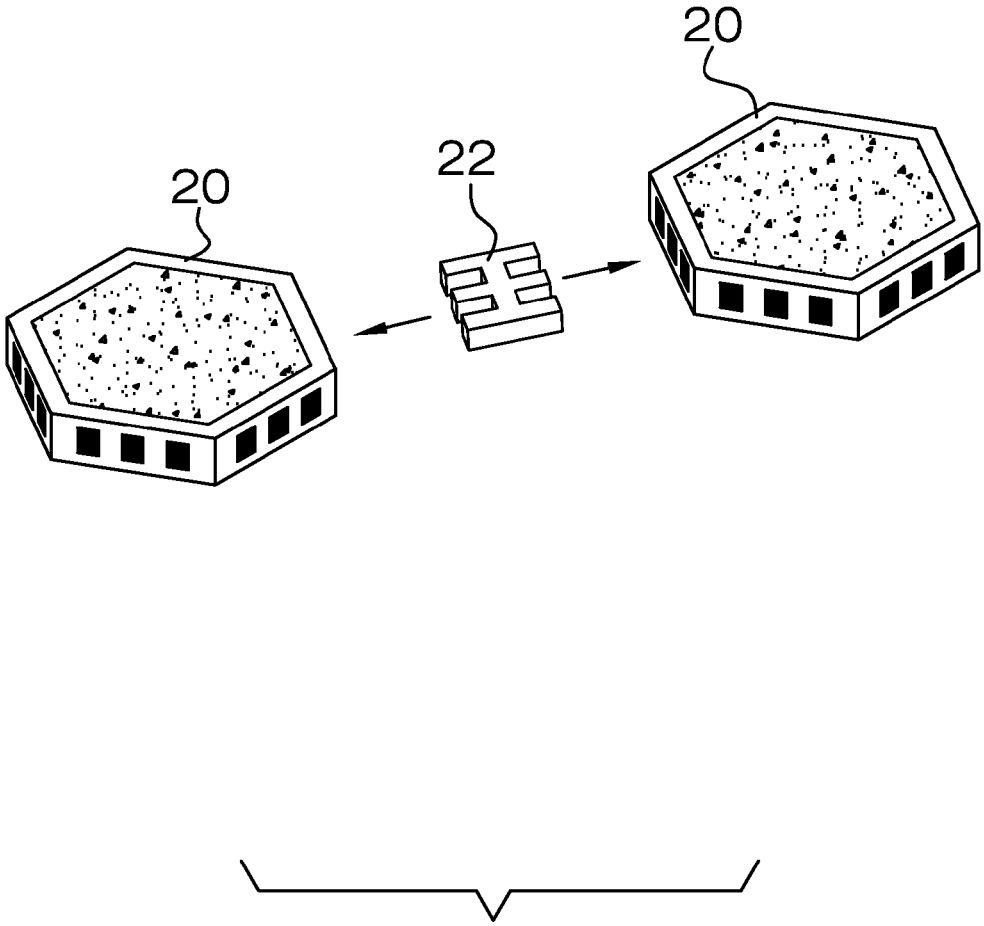
FIG. 1 is an isometric view of a pair of single-space game board pieces and a connector.
Figure 2:
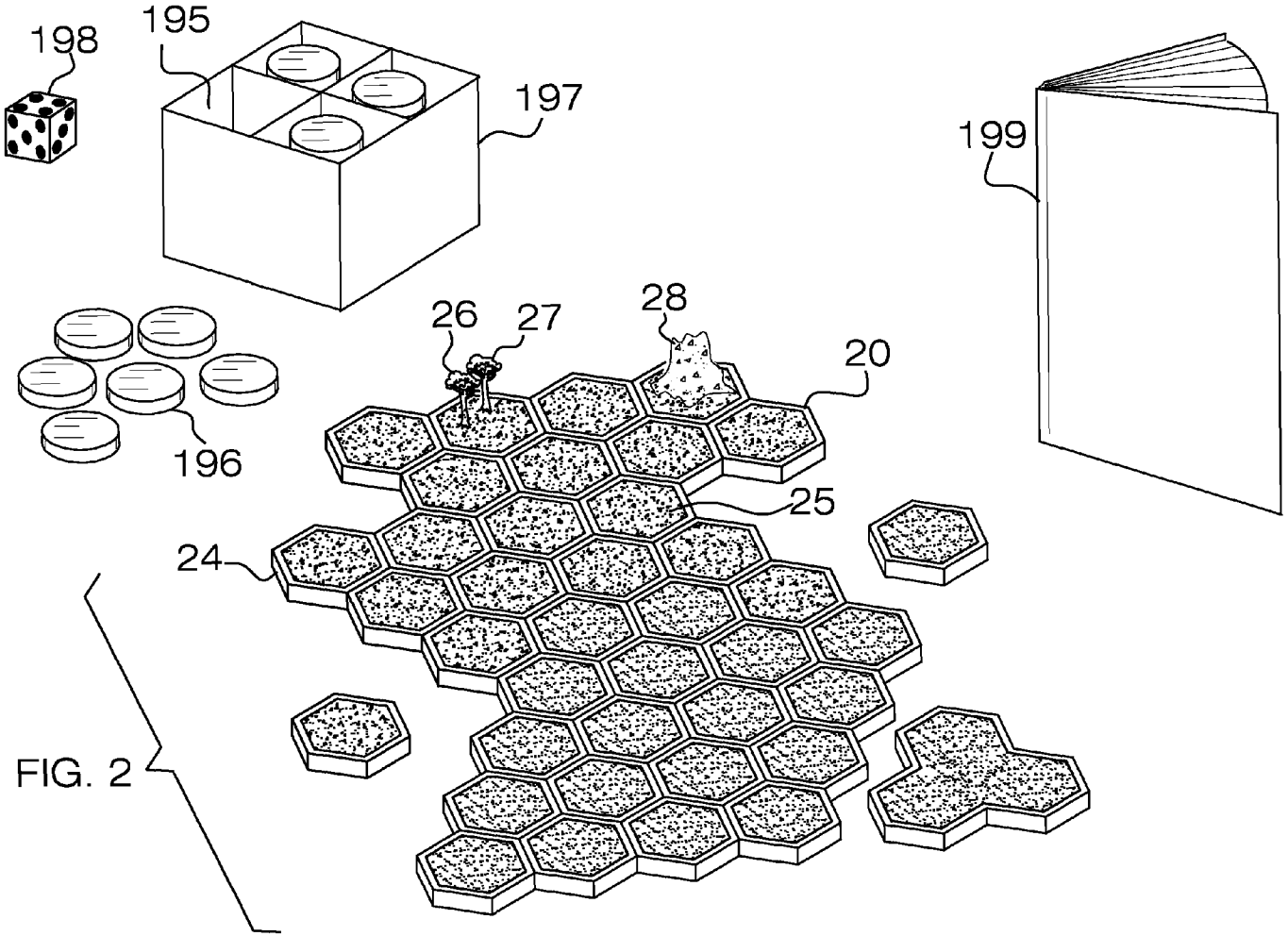
FIG. 2 is an isometric view of conjoined game board pieces, tokens, a die, and a rule book.
Figure 3:
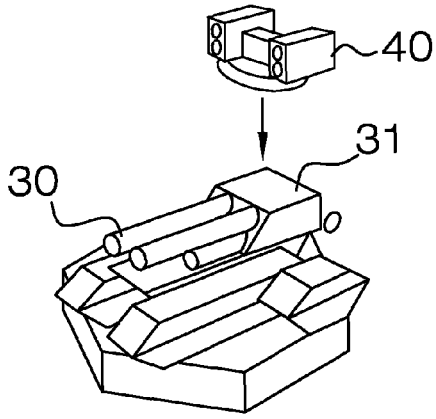
FIG. 3 is an isometric view of a model representing a tank and an add-on piece.
Figure 4:
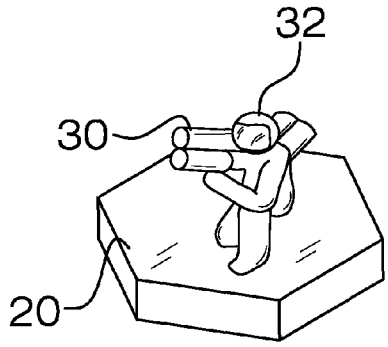
FIG. 4 is an isometric view of another model in the form of an action figure representing a juggernaut race member.
Figure 5:
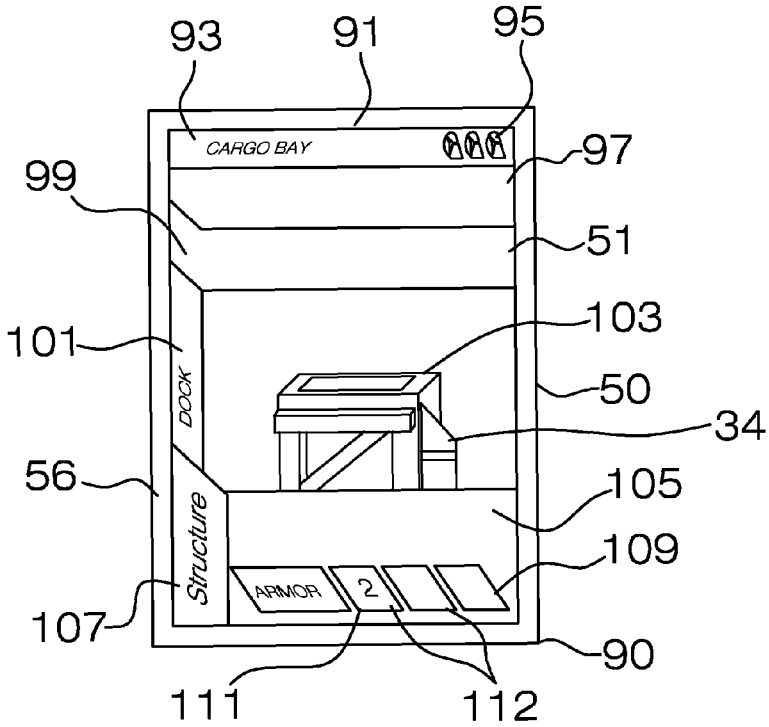
FIG. 5 is a rear elevation view of a structure card.
Figure 6:
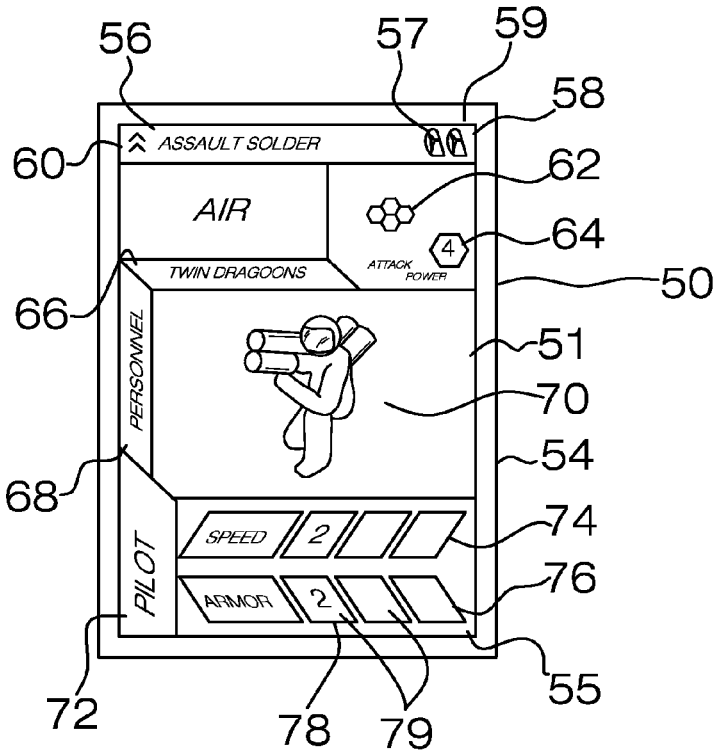
FIG. 6 is a rear elevation view of a pilot card.
Figure 7:
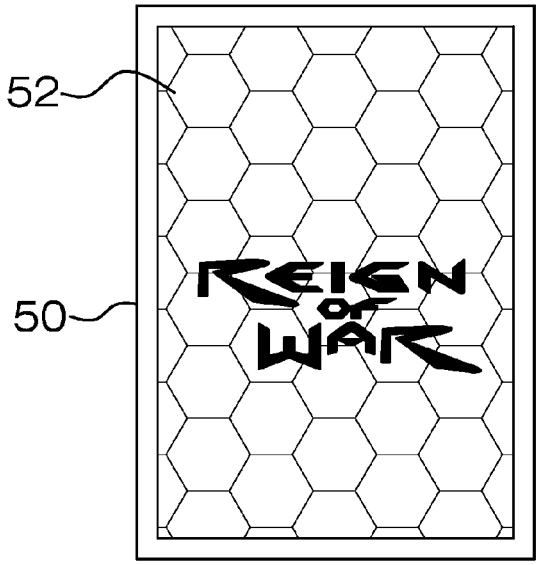
FIG. 7 is a front elevation view of a card.
Figure 8:
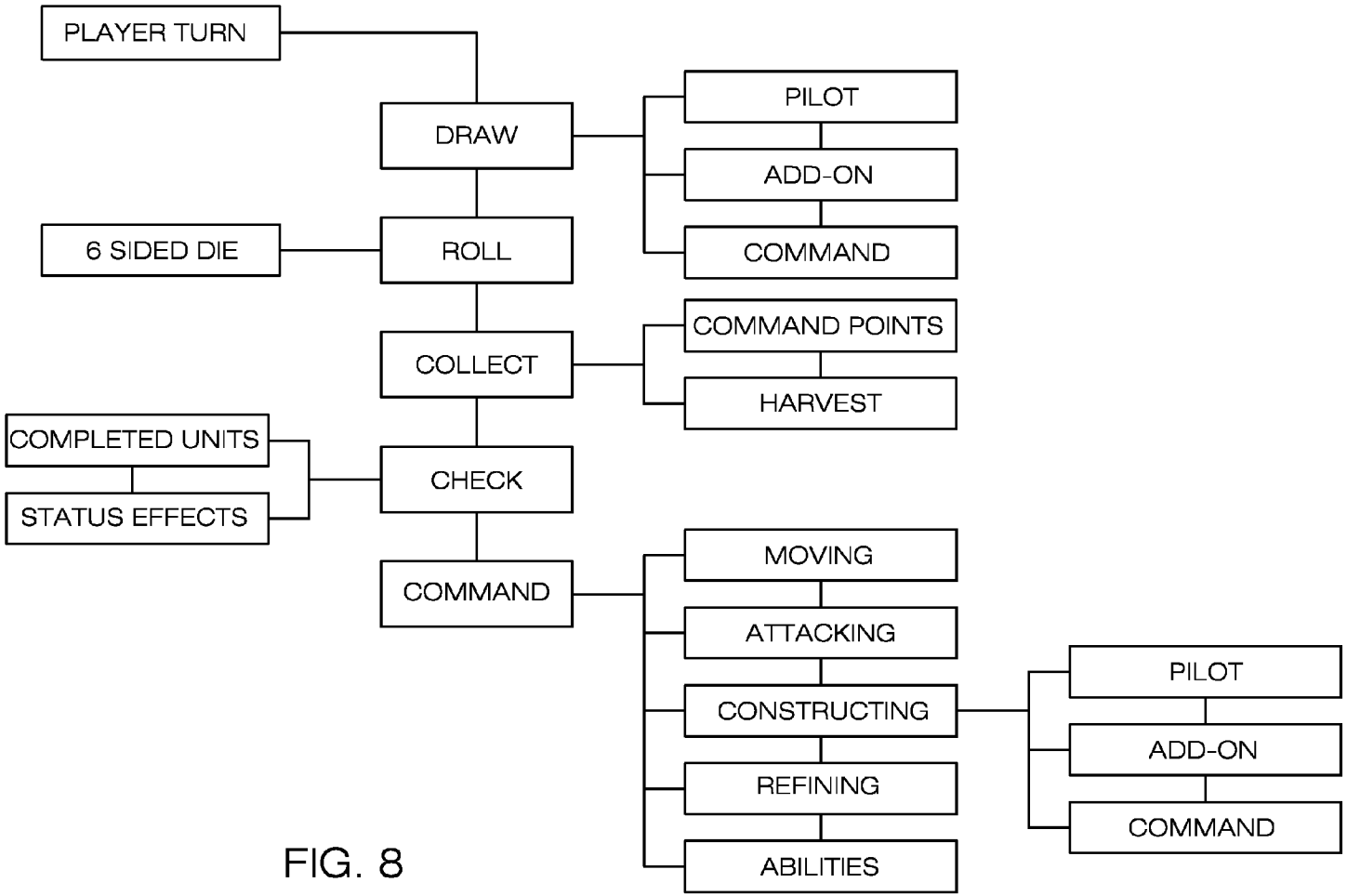
FIG. 8 is a block diagram of exemplary game play.
Figure 9:
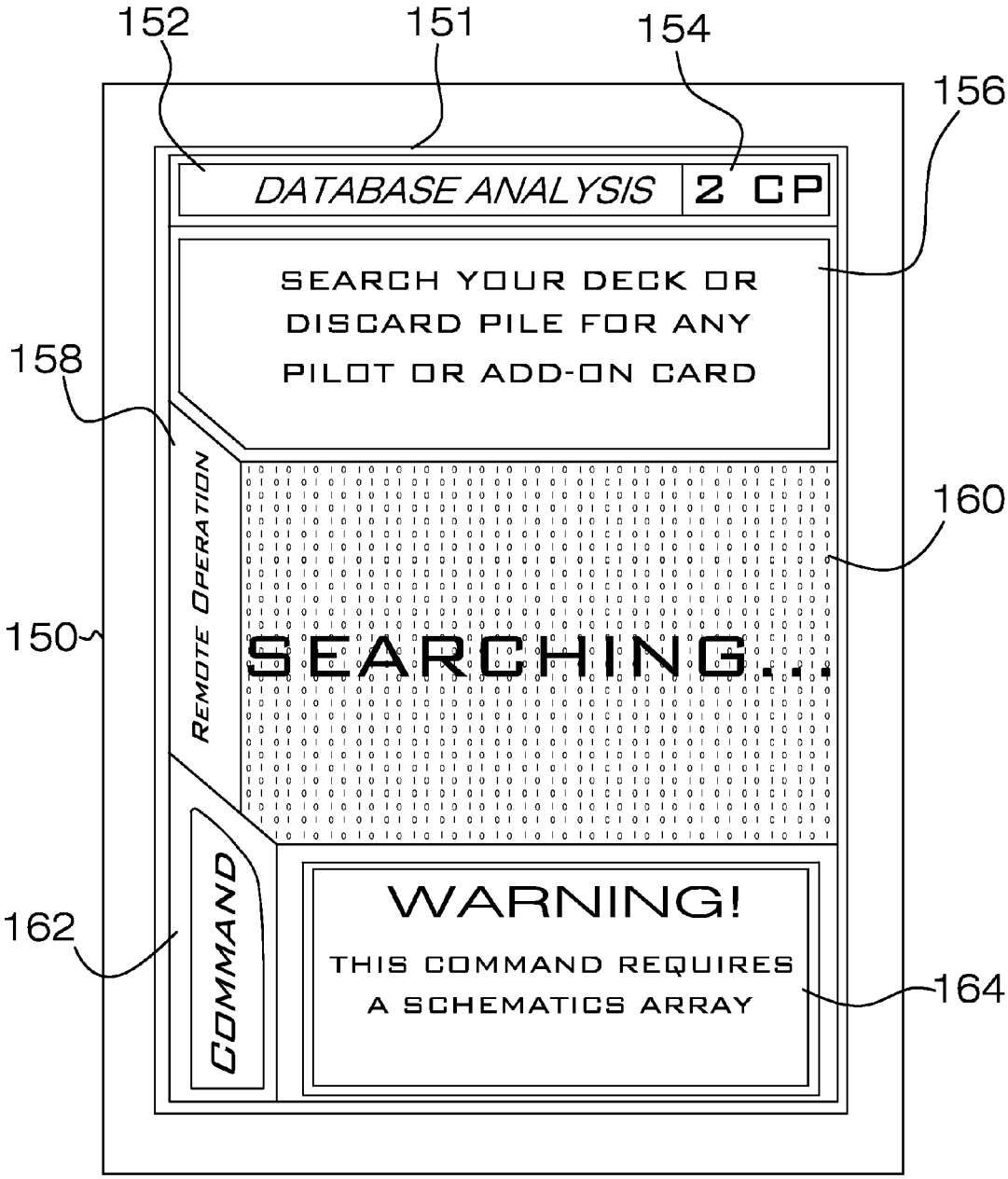
FIG. 9 is a rear elevation view of a command card.
Figure 10:
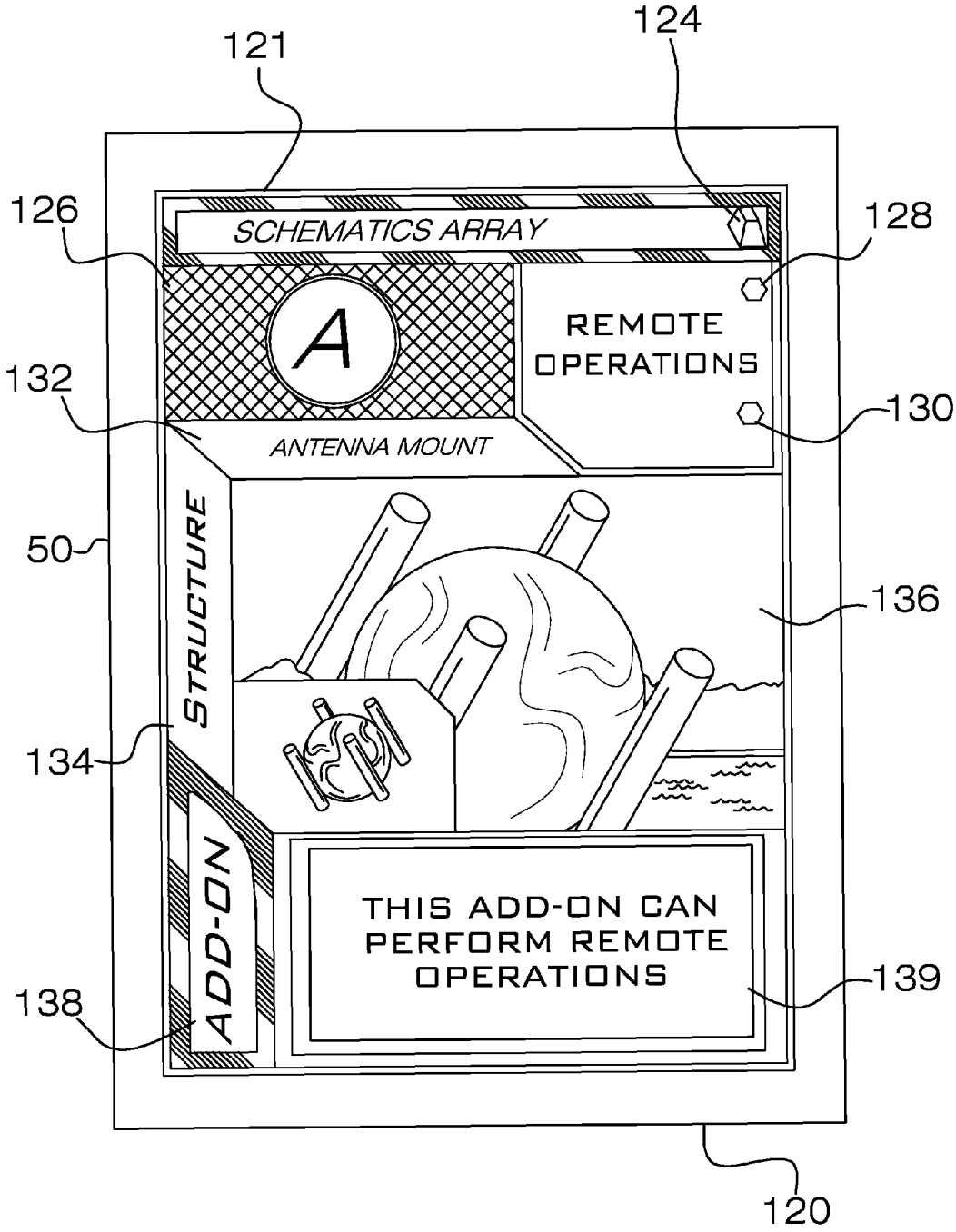
FIG. 10 is a rear elevation view of an add-on card.
Figure 11:
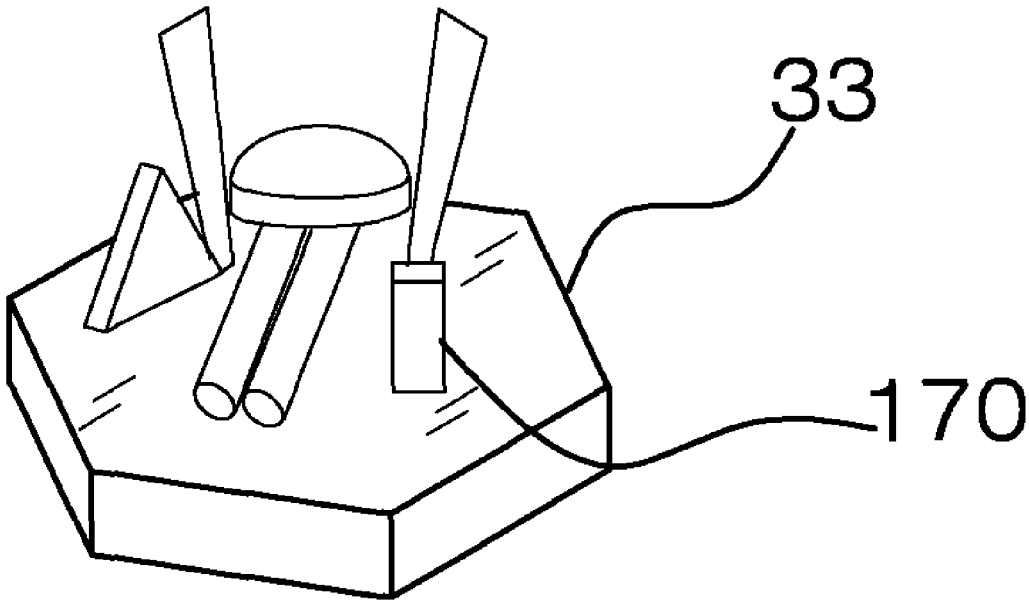
FIG. 11 is an isometric view of a battlefield unit having a health peg attached thereto.

With reference now to the drawings, and in particular FIGS. 1 through 13 thereof, example of the instant role-playing board game employing the principles and concepts of the present role-playing board game and generally designated by the reference number 10 will be described.

Referring to FIGS. 1 through 13, the present role-playing board game 10 is illustrated. The role-playing board game 10 utilizes a plurality of three-dimensional game board pieces 20 which are selectively interconnected via a plurality of connectors 22 to form a game board 24. Each map piece 20 forms a game board 24 space 25. The game board pieces 20 may be hexagonal. The game board pieces 20 are provided in the form of single-space game board pieces and multi-space game board pieces in a range of a three-space map piece which occupies 3 single-space game board pieces to multi-space map piece which occupies at least 7 single-space game board pieces. A three-dimensional terrain feature 26, which may be a tree 27 or mountain 28, may be removably disposed atop some of the game board pieces 20. A player may not attack through a three-dimensional terrain feature 26, a tree 27, a mountain 28, or a unit of the same elevation. A battlefield unit 33 may be a ground-bound elevation unit 45 or air-bound elevation unit 46. A player may not move a unit 33 onto a game board space 25 occupied by a three-dimensional terrain feature 26, a tree 27, a mountain 28, or a unit of any elevation 33, 45, 46.

The present board game 10 also utilizes a plurality of 3-dimensional models 30 representing two futuristic races, which may be juggernaut pilot units 32 forming a humanoid-based race, and scython pilot units 31 forming a machine-based race. A 3-dimensional model 30 may also represent various battlefield units 33, including a tank, a command center, a vehicle, a harvester, a cargo bay, a cargo dropship, or an airship, or a structural unit 34, such as a refinery, a cargo net, and an ore foundry. A plurality of attachable accessories each referred to herein as an add-on 40, a plurality of cards 50, each having a rear side 51 and a front side 52 are also utilized in the present board game 10. The cards 50 are categorized as pilot cards 54, structure cards 90, add-on cards 120, and command cards 150. Each card category provides a different set of capabilities. The present board game 10 also utilizes a plurality of tokens 196, at least one die 198, and a rule book 199. A plurality of boxes 197, each of which is divided into sections 195 to store each player's tokens 196, may also be provided. Each box may have four sections 195.

The add-on attachable accessory 40 may include a personnel pack, an armor, a speed enhancer, a range enhancer, a secondary weapon, and a flag. Each add-on attachable accessory 40 may be side mounted, turret mounted or rear mounted onto a vehicle, or booster mounted, under mounted, flank mounted, or deck mounted onto an airship, or antenna mounted, enhancer mounted, or weapon mounted onto a structural unit 34.

Figure 13:
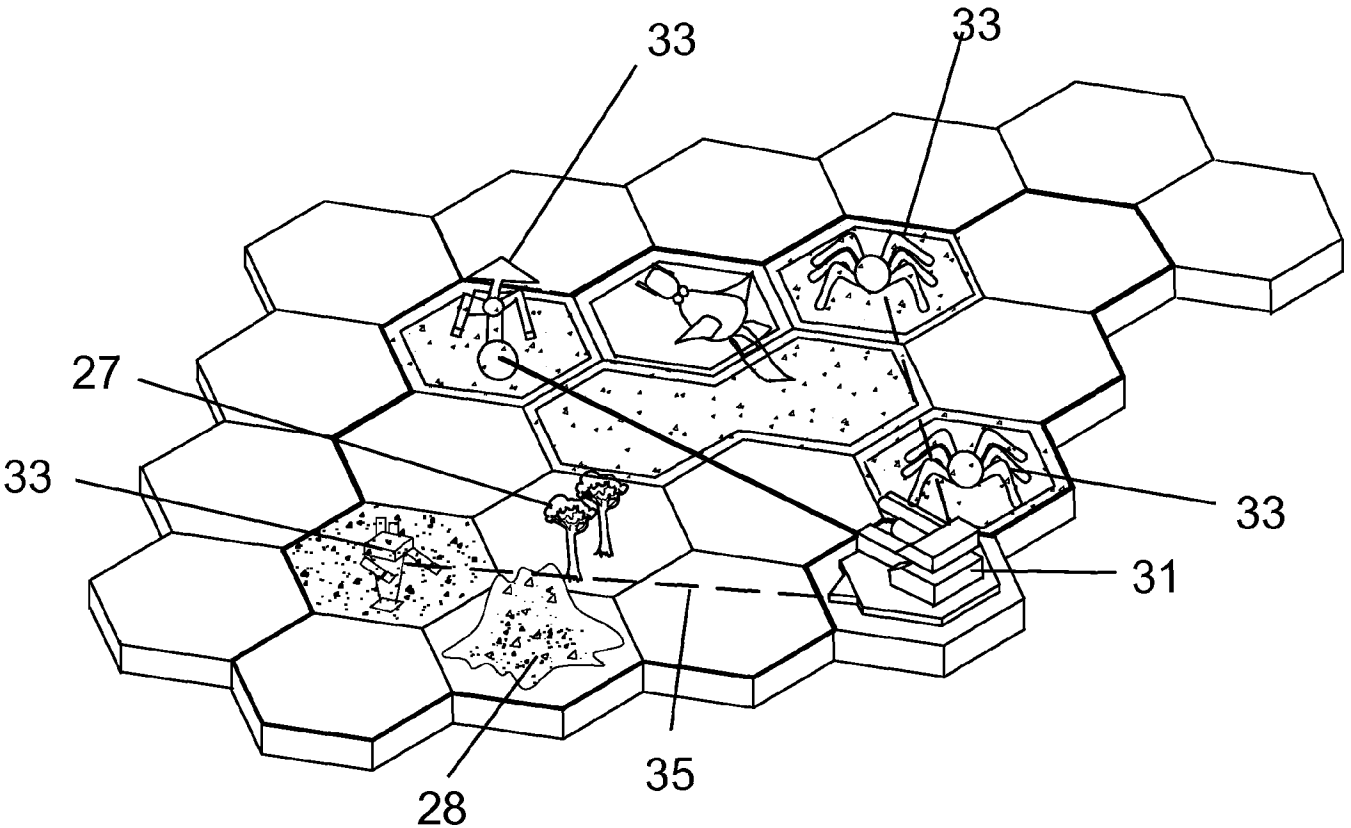
FIG. 13 is an isometric view illustrating an example of game play in which there is a line of sight and also an obstructed line of sight.

Each pilot card 54 rear side 51 bears a first data set 55 to keep track of a battlefield unit's statistics and includes a pilot card name 56, an ore-alloy pilot cost 58, status effect and additional information 60, pilot range 62, pilot attack power 64, primary weapon 66, unit type-building type required 68, a pilot picture 70, card classification 72, speed 74, armor points 76, and health information 78. There are 3 types of pilot cards 54: Pilot Personnel card 80, Pilot Vehicle card 82, and Pilot Airship card 83. The status effect and additional information 60 provides special information about a unit 33, 34 and what type of mount is available for an add-on 40. The term "unit" may refer to a scython or juggernaut pilot unit 31, 32, a structural unit 34, which may also be referred to herein as a structure, or an add-on 40, also referred to herein as an attachable accessory. The unit type-building type required 68 provides the type of unit given to the player and the structural unit in which the pilot or add-on 40 is constructed. For example, Havoc Tank is a vehicle type battlefield unit 33 constructed at a vehicle structural unit 34. Pilot health information 78 provides information regarding how much health the unit on the pilot card 54 possesses as indicated by green, yellow and red pilot health bars 79, with green indicating the greatest amount of health and red indicating the lowest amount of health. Pilot armor points 76 indicate the number of points possessed by a unit corresponding to the current pilot health bar 79. Speed 74 indicates how fast a unit moves corresponding to the current pilot health bar 79. Pilot range 62 indicates how much firing range 141 the primary weapon has for the attacking unit. An attack pattern 200, an example of which is shown in FIG. 13 in graveled spaces, is determined by a unit's 33 firing range 141 and firing direction 142 indicators 201 indicated on a base 203 of a unit 33. FIG. 13 illustrates a unit 33 having, for example, a firing range of 3 and a three firing direction 142 indicators 201, which allows the unit 33 to fire in a clear line-of-sight 35 to attack an enemy unit 33, but which cannot attack with an obstructed line-of-sight 36, which while within range, are not in a straight line from a firing indicator. The blank spaces 205 are untargetable since the blank spaces 205 are neither within firing range 141 nor in a straight line from a firing direction 142 indicator 201. A clear line of sight 35 is determined by drawing a straight line from one of the closest firing direction indicators 201 to the center of all occupied spaces by the targeted unit 33 as shown in FIG. 13. A unit's line of sight 35 may be blocked by a three-dimensional terrain feature 26, tree 27, mountain 28, or unit of same elevation. Pilot attack power 64 indicates how much power the attacking unit has from the unit's primary weapon. Ore-alloy pilot cost 58 informs a player how much ore 57 or alloy 59, differentiated by different colors, is required to construct the unit. Ore 57 may be designated by a gold color and alloy 59 may be designated by a silver color.

Each structure card 90 rear side 51 bears a second data set 91 to keep track of a structural unit's 34 statistics and includes a structure card name 93, a ore-alloy structure cost 95, structure primary ability 97, structure secondary ability 99, a structure type 101, a structure picture 103, units produced 105, a structure card classification 107, structure armor points 109, and structure health information 111. The types of structure cards 50 include: command center, harvester, refinery, defense, offense, personnel, vehicle, airship, power line, power supply, and dock. Both juggernaut pilot units 32 and scython pilot units 31 receive command center, harvester, refinery, defense, offense, personnel, vehicle, and airship structure cards. However, power line and power supply structure cards pertain only to scython pilot units 31, while dock structure cards 90 pertain only to juggernaut pilot units 32. Ore-alloy structure cost 95 tells a player how much ore 57 or alloy 59 is required to construct the structure. Structure health information 111 tells a player how much health a structure possesses via green, yellow and red structure health bars 112. Structure armor points 109 indicate how many armor points a structure corresponding to the current structure health bars 112. The structure primary ability 97 is either a passive or a CP ability such as search or allowing a player to collect ore. The structure secondary ability 99 is given to only some structures. Units produced 105 tells a player what kind of unit is produced at this structure. Not all structures are provided with the ability to construct units.

Each add-on card 120 rear side 51 bears a third data set 121 to keep track of the statistics for all of the attachable accessories 40 and includes an add-on card name 122, ore-alloy add-on cost, mount type symbol 126, add-on range 128, add-on attack power 130, mount type text 132, add-on type 134, a add-on picture 136, a card classification 138, and add-on abilities 139. The types of add-on cards 120 include a personnel pack accessory for personnel; side mounted, turret mounted and rear mounted accessories for vehicles; booster mounted, under mounted, flank mounted, and deck mounted accessories for airships; and antenna mounted, enhancer mounted, and weapon mounted accessories for structures. The mount type symbol 125 and the mount type text 132 tell a player the location in which the add-on 40 can be mounted onto a unit. Only like mount type symbols 125 can be connected. The add-on type 134 indicates the type of add-on 40 that can be used by a type of unit. The add-on range 128 indicates how much firing range 141 the add-on 40 has for the matching unit. An add-on attack pattern 140 is determined by its firing range 141 and firing direction 142 indicated on the matching unit's base 203. An add-on clear line-of-sight 35 is determined by drawing a straight line from the closest firing direction 142 indicator 201 displayed on the unit's base 203 to the center of the occupied space(s) of the targeted unit. The add-on attack power 130 indicates how much attack power the unit has from the add-on shown on the add-on card 120. Some add-ons 40 may not attack but may, instead, perform other abilities as marked with a plus sign +. The add-on abilities 139 tell a player what type of special capabilities the add-on 40 possesses. The ore-alloy add-on cost 124 tells a player how much ore or alloy is required to construct the attachable accessory shown on the add-on card 120.

Each command card 150 rear side 51 bears a fourth data set 151 to affect player's abilities and includes a command card name 152, a command point cost 154, a command primary ability 156, command type 158, a command picture 160, a command card classification 162, and a command secondary ability 164. Two types of commands cards 150 are build orders and special operations. Command type 158 includes build orders as well as special operations. The command primary ability 156 and command secondary ability 164, shown below the command primary ability 156, tells a player what the command card 150 does for its main function.

A health peg 170 removably attached to a battlefield unit 33 indicates the current health of the battlefield unit 33 and the ownership of the battlefield unit 33. The tokens 196 are divided into different colors and symbols. Each token 196 color represents a command point, a common ore 57, or a metal alloy 59. Each symbol represents a status effect. Each colored token 196 may be placed into a different section 95 within a player's box 197.

Exemplary Rules of Play:

The present role-playing board game 10 may be played in various game modes having different objectives.

Prior to beginning a game played in any game mode, game board pieces 20 are assembled into a game board 24. The game board pieces 20 may be assembled according to a map scenario as provided in the rule book 199 or into a custom map. The cards 50 are divided into a draw stack and a second structure stack for each player. The draw stack contains command cards 60, pilot cards 54, and add-on cards 58. The structure stack contains structure cards 56. In the draw stack there may be a total of 60 cards and in the structure stack there may be a total of 12 cards. In the event a player depletes his draw pile, the player shuffles the discard pile to form a replacement draw pile.

Also, a single command center, at least four tokens 196 each representing common ore, at least two tokens 196 each representing a metal alloy, and at least six tokens 196 each representing a command point are distributed to each player. The different colored tokens 196 may be divided and placed into each player's box 197. A die 198 may also be distributed to each player or a single die 198 may be used by all players. Each player selects either a juggernaut 32 model 30 or a scython 31 model 30.

To initiate a new game of game play in any mode, each player throws a die 198 and the player rolling the highest count on the die 198 begins the round. The cycle of each player taking a turn is one completed round. The first player takes a turn by drawing a card from the draw pile and rolling the die 198 to collect command points. The player collects 1 ore from the player's command center and 2 ore from additional harvesters. At the beginning of each turn, each player must check for the status effects 60 for units 31, 32, 33, 34 and add-ons 40 that have completed construction. The turn ends when the players agree to end the turn or all command points of a player have been depleted; provided, however, a player who retains command points may roll over his remaining command points to the next round. The rule book 199 may be consulted at any time for rules about setting up the game board and game play rules.

In all game modes, command points are tallied at the beginning of each turn and are used to perform every operation throughout a game round. The command points are used to pay for a command point cost 154, for converting ore to alloy, moving units, providing structure abilities, attacking with units, attacking with add-ons, and constructing units, including add-ons. Every operation for which a specific command point is not assigned by a command card requires 1 command point to perform. Also, in all game modes, resources are used to construct units and structures throughout a game round. Each command card 150 may be used only once. In order to build a structure, a player must possess a build order command card 150 and the required amount of resources to build the structural unit. To build a structural unit or an add-on, a player must possess a corresponding building unit, one command point, and either a single common ore module or a single metal alloy module which has been converted from three common ore modules, as required.

Each unit 33 may move only once per turn. In addition, each unit and each add-on may only attack once per turn. Each add-on can be used once per turn until the unit drops the add-on or is destroyed along with the unit. Each add-on assumes the current armor of the unit to which the add-on is mounted. Each destroyed unit and add-on is placed into a discard pile.

Each player may construct as many structures provided the player possesses a build order and the resources which includes the required number of command points and ore. Each structure may perform only one operation per turn. Each structure may construct only one unit and one add-on per turn. Construction of each unit and each add-on requires one turn to complete and such unit and add-on are placed temporarily on top of the structure card during construction. Each unit and each add-on for which construction is complete is placed on the game board 24 within the player's territory adjacent to the structure in which the unit or add-on was constructed. The areas in which a unit or add-on can be placed are marked on the sides of the base of each structure.

In addition, for all game modes, there are various status effects 60. An electromagnetic pulse is a status effect 60, shown as "EMP" symbol on a pilot card 54, temporarily disables a targeted unit for either 1 or 2 rounds as indicated by the status effect 60 as either x1 or x2, respectively. An "EMP" symbol marked through by a diagonal line on a pilot card 54 makes a targeted unit resistant to an EMP attack. A blind is a status effect 60 that reduces a unit's primary attack power and all mounted add-ons range to 1. A pierce is a status effect 60 which means that an attack by a unit temporarily reduces an opponent's targeted unit's armor points by 1 for one round. If the attack power is not strong enough to do damage to the armor of an opponent's unit, the pierce temporarily reduces the armor points by 1. A stackable is a status effect 60 which means an effect can be added to a unit more than once per round. For example, hitting a unit with pierce twice makes it lose 2 armor points for that round. A defensive strike is a status effect 60 that means a unit can attack when an opposing unit moves within firing range 141. A defensive strike targets a single unit at a time. Also if the unit is still in firing range 141 at the beginning of the next round it attacks again. A unit with defensive strike cannot attack with a player's command. A cluster damage—area effect is a status effect 60 that means that all adjacent spaces surrounding a targeted space on the map are affected by the attack. An invulnerable effect is a status effect 60 prevents attack on a unit for 1 or 2 rounds as indicated by x1 or x2, respectively. A targeted as air status effect 60 means that units can only be targeted by air attacks. Also these units may fly over obstacles, structures and units but may not hover over them. A targets air status effect 60 allows a unit to attack a targeted unit that is designated as targeted as air. A Targets Air Only status effect 60 permits a unit to attack only a targeted unit that is designated as targeted as air.

The primary abilities 97 provided solely for a juggernaut 32 include a drop in structure, a cargo bay, an ore foundry, and a cargo net. The primary abilities 97 provided solely for a scython 31 include a power supply, a power line, a capacitor stacking, and a unit-structure. The drop in structure requires a player to possess a cargo dock and cargo dropship in order to construct a structure. While each structure is being transported, such structure cannot be targeted for destruction, however, the cargo dropship may be targeted. If the cargo dropship is destroyed while carrying a structure, the structure being carried is also destroyed. In addition, after a structure is built, the structure must be transported from a cargo bay with the cargo dropship added to the top of the structure. From the cargo bay, the cargo dropship can move a structure to any location on the game board 24 as speed 74 allows. Once a structure is in the desired location, the dropship instantly returns to the cargo bay from which the drop ship started. A cargo bay allows a player to house a cargo dropship. However, if a cargo bay is disabled or destroyed, the cargo bay may no longer produce a structure. The cargo dropship associated with the cargo bay may move to the next cargo bay without cost, unless cargo dropship parked on top of the cargo bay at the time of destruction in which case the cargo drop ship is also destroyed. An ore foundry can convert common ore into metal alloy and also reduce the amount of common ore required to convert as a player accumulates more ore foundries. Possession of one foundry allows a player to convert three common ore modules into 1 metal alloy module. A cargo net is used to move 1 add-on at a time around the game board. Each add-on is moved by a cargo dropship and can be picked up or dropped off on any available game board space. Once a unit moves into a space where an add-on is located, the unit instantly picks up the add-on, which is mounted to an appropriate mount. A power supply allows a scython to power a structure to operate. A power supply may be a cybernetic coretex or a fusion capacitor. A power line allows a scython to connect structures together to carry out various operations. A new structure must be connected to a power line from a cybernetic coretex without a break. A break includes any disable or destroyed structure along the power line. A repaired structure must be connected to a fusion capacitor without a break in the power line. Capacitor stacking allows a player to connect multiple capacitors to strengthen structures and abilities. Each connected fusion cyclotron capacitor increases attack power by 1. Further, each connected fusion cyclotron capacitor reduces the cost of structure installation by one command point. A linxix unit is a special type of scython unit that can move and attack like a unit or can be connected as a fusion cyclotron capacitor. A linxix may be used to attack while in location as a fusion cyclotron capacitor, but moving the linxix to attack breaks the connection.

All units 33 initially have green health bars, which are reduced until the last bar of health is reached. A unit may be attacked when the last bar of health is reached and upon such attack, the unit is disabled and unable to perform any operations. If the unit has an armor point level of zero, the unit can by destroyed or repaired. If a unit is attacked while disabled, the unit is destroyed and removed from the game board 24.

In order to move a unit a single space on the game board, the player must expend one command point. A unit may be moved only once per round. A single-space unit can move in any direction and rotate in any direction. A two-space unit can pivot on the back space and move forward and back. A three-space unit moves diagonally only. In addition, to move a unit to a space requires one speed to perform.

Each unit that has a firing range 141 and attack power may attack any unit, including one belonging to the player's side. A unit may not attack itself. The attack power of a unit must be equal to or greater than the armor points of the unit being attacked. An attacked unit loses one health bar.

Figure 12:
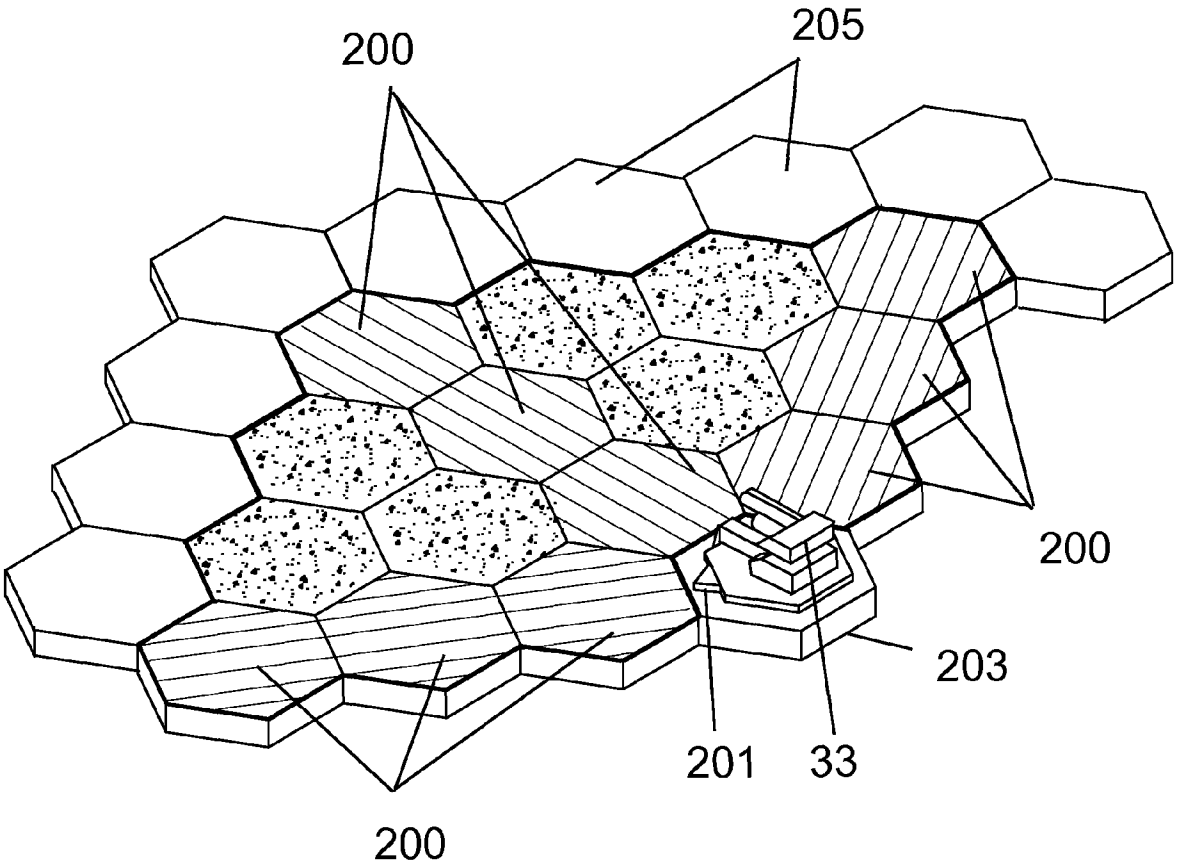
FIG. 12 is an isometric view illustrating a battlefield unit's fire range and attack pattern.

FIG. 12 illustrates untargetable areas 205 shown as blank spaces, attackable areas 206 shown as striped spaces within a firing range 141 of 3 and a firing direction 142, and fill-in areas 207 shown as spattered spaces, which are within firing range 141, but not within the firing direction 142 of the unit 31. In FIG. 13, a clear line of sight 35 shows a player whether his unit 33 can attack successfully as shown by the solid line leading to a unit 33, such as the shown ground-bound unit 45, or whether a possible attack is through an obstructed line-of slight 36, shown as dashed lines. A clear line-of-sight 35 is determined by first locating the firing direction indictors 201 on the base 203 of a unit 33, drawing a straight line from the closest firing direction indicator 201 to the center of the occupied spaces of the targeted unit, and determining that the clear line-of-sight 35 is unobstructed by three-dimensional terrain feature 26, tree 27, mountain 28, or another unit 33 having same elevation.

Construction of structures and units, including add-ons, requires sufficient resources. A player may gain additional resources by placing a harvester on top of an ore deposit by which a player will receive common ore during the collection stage of a player's turn. To convert the common ore into metal alloy, a player must possess a refinery and pay the cost to have the ore converted. Conversion may be performed only once per turn per refinery.

The objective of a first game mode, a melee game mode, is to destroy the opponents' command center, at which time the round ends. The first game mode is the classic mode of playing the present board game 10. The standard starting resources are distributed to each player. The objective of a second game mode, which is a free-for-all game mode, is to destroy all of the opponents' units and structures, the round ending when all of the pilot units 31,32, battlefield units 33, and structural units 34 of one of the player's are destroyed.

The standard starting resources are distributed to each player. The objective of a third game mode, a capture-the-flag game mode, is to pick up a flag which is placed in the center of the game board 24 and return the flag to the command center to score a point. Each player starts with the standard resources and no points. Battlefield units may pick up the flag and mount the flag to any available mount. If a unit is destroyed while carrying the flag, the flag is placed in the location of the unit's destruction. Each time a player returns the flag to his command center, the player receives 1 point and the flag is returned to the center of the game board. There are three levels of difficulty: The easy level requires 3 points to win; the normal level requires 6 points to win; the epic level requires 9 points to win. The objective of a fourth game mode, a king-of-the-hill game mode, is to hold a position on the game board for a certain specified number of rounds. As with the other game modes, each player starts with the starting resources. A map scenario contained in the rule book 199 informs the players which map spaces must be held. There are 3 levels of difficulty. The easy level requires 3 rounds to win. The normal level requires 6 rounds to win. The epic level requires 9 rounds to win.

In other embodiments of said role-playing board game 10, players may make their own custom game board 24 but must place command centers 3 to 6 spaces away from the edge of the game board 24; must place each command center on opposite sides of the game board 24; must place 1 ore deposit at least 3 spaces away from each command center; and should leave a 2-space path between all obstacles.

With respect to the above description then, it is to be realized that the optimum dimensional relationships for the parts of the present role-playing board game to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of playing a role-playing board game comprising:

selectively interconnecting a plurality of three-dimensional game board pieces;

selectively interconnecting a plurality of connectors between the game board pieces, wherein each game board piece is a game board space;

removably disposing a three-dimensional terrain feature on at least one of the game board pieces;

dividing a plurality of three-dimensional units divided into humanoid-shaped units, machine-shaped units, transportation-shaped units, building units, and structural units, each unit having a base;

transforming at least one humanoid-shaped unit from a first condition to a second condition:

transforming at least one machine-shaped unit from a first condition to a second condition;

wherein the first condition is the selective removable attachment of a plurality of attachable accessories onto each of the humanoid-shaped units and onto each of the machine-shaped units;

dividing a plurality of tokens into sets, each set having a unique color and a unique symbol, the tokens representing ore, alloys, command points, and status effects;

throwing at least one die and moving the number of game board spaces shown on the die;

dividing a plurality of pegs into two set, each set having a unique color selectively removably attaching each peg to one of the units;

distributing a draw stack to each player, each draw stack comprising the command cards, the pilot cards, and the add-on cards;

distributing to each player a single command center, at least four tokens each representing common ore, at least two tokens each representing a metal alloy, and at least six tokens each representing a command point;

moving each player's command center within the player's territory;

placing a number of tokens representing command points required by a unit to perform an operation into a token discard pile, wherein an operation comprises converting at least one of the tokens representing ore with at least one token representing alloy, moving a unit on at least one game board space, attacking a unit of an opposing player, constructing one of the structural units prior to placing the structural unit onto the game board, constructing one of the attachable accessories prior to adding the attachable accessory to a unit;

moving one of the building units onto the game board upon acquisition of a building unit by a player;

constructing a structural unit during a player's turn by expending a command card designated as a build order command card, expending a required number of command points, and expending a required amount of ore and alloy and further by possessing a building unit that corresponds to the structural unit;

constructing an attachable accessory during a player's turn;

placing each completely constructed structural unit and each attachable accessory on the game board space adjacent to the building unit in which the structural unit and attachable accessory was constructed during the player's turn next following completion of construction;

removing an attachable accessory from a unit upon expenditure of the attachable accessory;

wherein the second condition is the removal of at least one of the humanoid-shaped units and at least one of the machine-shaped unit and a pilot card bearing a firing direction and a range to allow the unit to land on one of the game board spaces occupied by the opposing player's unit and bearing an attack pilot power at least equal to a number of armor points corresponding to the opposing player's unit;

removing a unit upon a player's having an attachable accessory mounted to a unit and an add-on card bearing a firing direction and an add-on range wherein the add on moves onto one of the game board spaces occupied by the opposing player's unit and bearing an add-on attack power at least equal to a number of the armor points corresponding to the opposing player's unit.

* * * * *